US008099892B1

(12) United States Patent
Strömberg

(10) Patent No.: US 8,099,892 B1
(45) Date of Patent: Jan. 24, 2012

(54) RECOIL DAMPENING MECHANISM

(75) Inventor: Håkan Strömberg, Eskilstuna (SE)

(73) Assignee: SAAB AB, Linköping (SE)

( * ) Notice: Subject to any disclaimer, the term of this patent is extended or adjusted under 35 U.S.C. 154(b) by 146 days.

(21) Appl. No.: 12/470,575

(22) Filed: May 22, 2009

(30) Foreign Application Priority Data

May 27, 2008 (EP) ..... 08445021

(51) Int. Cl.
*F41A 1/08* (2006.01)
*F41A 21/36* (2006.01)

(52) U.S. Cl. ..... 42/1.06; 89/1.7; 89/1.701; 89/14.3

(58) Field of Classification Search ..... 42/1.06; 89/1.7, 1.701, 14, 3, 143; 188/267.1, 267.2
See application file for complete search history.

(56) References Cited

U.S. PATENT DOCUMENTS

| | | | | |
|---|---|---|---|---|
| 2,413,703 | A | 1/1947 | Fischer | |
| 2,765,708 | A | 10/1956 | Raines | |
| 2,818,783 | A | 1/1958 | Carlson et al. | |
| 3,279,072 | A * | 10/1966 | Choate et al. | 42/136 |
| 3,969,827 | A * | 7/1976 | Ellis | 42/136 |
| 3,969,982 | A * | 7/1976 | Pier-Amory et al. | 89/178 |
| 4,461,087 | A * | 7/1984 | Norman | 42/128 |
| 4,672,881 | A | 6/1987 | Betts et al. | |
| 4,856,409 | A * | 8/1989 | Bowden | 89/1.819 |
| 5,239,909 | A * | 8/1993 | Bell et al. | 89/1.807 |
| 5,491,917 | A | 2/1996 | Dilhan et al. | |
| 5,732,499 | A * | 3/1998 | Canaday et al. | 42/75.02 |
| 6,745,663 | B2 * | 6/2004 | Ebersole et al. | 89/42.01 |
| 6,779,290 | B1 * | 8/2004 | Houtsma | 42/148 |
| 7,380,487 | B2 * | 6/2008 | Mantras | 89/42.01 |
| 7,624,668 | B1 * | 12/2009 | Sanford | 89/1.701 |
| 2002/0112601 | A1 * | 8/2002 | Sanford et al. | 89/1.701 |
| 2006/0048637 | A1 * | 3/2006 | Dimitrios | 89/14.3 |
| 2008/0000132 | A1 * | 1/2008 | Orvis et al. | 42/73 |
| 2010/0230216 | A1 * | 9/2010 | Fuchs et al. | 188/33 |

FOREIGN PATENT DOCUMENTS

| | | |
|---|---|---|
| DE | 19832495 | 10/1999 |
| EP | 0388305 | 9/1990 |

* cited by examiner

*Primary Examiner* — Bret Hayes
*Assistant Examiner* — Joshua Freeman
(74) *Attorney, Agent, or Firm* — Connolly Bove Lodge & Hutz LLP

(57) ABSTRACT

The invention concerns a recoilless weapon (1) comprising a launch tube (3) for launching a projectile and a recoil dampener (2) for dampening recoil forces from the projectile, characterized in that the recoil dampener (2) comprises at least two recoil dampening mechanisms (8) comprising dampening means (11, 13, 14, 15) and that the recoil dampener (2) is adjustable in regard to a gunner and/or to projectile.

11 Claims, 2 Drawing Sheets

RECOIL DAMPENING MECHANISM

The invention concerns a recoilless weapon comprising a launch tube, a loading mechanism and a recoil dampening mechanism.

A projectile launched from a handhold rocket weapon generates recoil forces, which recoil forces may be deleterious for a gunner that are handling the weapon, as well as for equipment attached to the weapon such as a sight and/or a tiring mechanism.

In order to decrease the recoil forces, it is known to have a recoil dampening mechanism arranged on the launch tube. One such recoil dampening mechanism is described in U.S. Pat. No. 4,672,881. The dampening mechanism in U.S. Pat. No. 4,672,881 comprises a support member formed as a support tube, which is resiliently attached to the launch tube. The support tube constitutes a part of the weapon, which a gunner is using when he is handling the weapon. The support tube comprises different equipments such as a firing mechanism, a sight and a shoulder support. The support tube is coupled to the launch tube by a resilient coupling. The support tube and the resilient coupling may be characterised as a floating tube arrangement. A resilient material is arranged between the support tube and the launch tube such that the launch tube is slideable in the support tube in response to a launch. The resilient material may be a rubber or a plastic material The floating tube arrangement in U.S. Pat. No. 4,672,881 has some serious disadvantages.

When the support tube slides backwards, only linear movement should be allowed and no angular movement permitted. However, as only the resilient material provides fixation of the support tube to the launch tube, there is an obvious risk that the launch tube will twist or tilt relative to the central axis of the weapon, especially if the resilient material has experienced degradation due to aging. Twisting or tilting will affect the accuracy of the launching seriously.

Another problem is the fact that the dampening effect is not adjustable in regard to a specific gunner; a female or a male, a strong or a weak person, or to a specific projectile, such as a heavy or a light projectile.

A further problem is that the dampening mechanism, is not easy shiftable from one launch tube to another lunch tube. This will make the dampening mechanism difficult to use more than once.

The main object of the invention is to provide an improved dampening mechanism, particularly for hand hold recoilless weapons, where said dampening mechanism is arranged such that twisting or tilting of the launch tube when launching a projectile is eliminated or decreased to a minimum.

A second object of the invention is to provide a dampening mechanism, which is adjustable in dampening effect in regard to a gunner or to a projectile.

A third object of the invention is to provide a dampening mechanism, which is easy shiftable from one launch tube to another launch tube, making the dampening mechanism reusable in an economical and environmental respect.

SUMMARY OF THE INVENTION

The above and other objects are achieved by a recoil dampener that comprises at least two recoil dampening mechanisms comprising dampening means and that the recoil dampener is adjustable in regard to a gunner and/or to projectile.

Further aspects of the recoil dampener according to the invention are:

the recoil dampener further comprises a support cover, which support comprises a shoulder rest, a sight and a firing mechanism, the at least two recoil dampening mechanisms are mounted in a recoil dampening mechanism housing, which recoil dampening mechanism housing comprises mounting and locking means for mounting and locking the recoil dampening mechanism housing on the launch tube, the dampening means for each recoil dampening mechanism comprises at least two bearing pads, a piston, a piston cylinder and at least one spring the dampening means comprises a piston, a piston cylinder and at least one spring.

the piston is slideable mounted in the piston cylinder inside the recoil dampening mechanism housing and that the piston is biased by the at least one spring.

the piston is slideable mounted in a piston cylinder inside the recoil dampening mechanism housing and that the piston is biased by the at least one spring, which spring is a coil spring and arranged coaxially on the piston, the at least one spring is an electromagnetic spring, the support cover is mounted on the pistons, the shoulder rest and the sight are mounted on the support cover by snap mechanisms, the mounting and locking means comprises a snap mechanism, the recoil dampener is adjustable by biasing the bearing pads radially towards support cover, the dampening of the recoil dampener is adjustable by adjusting the support cover axially along the launch tube, the sight is mounted on a lever arm, which lever arm is foldable between an active position and a non-active position.

Main advantages of the dampening mechanism according to the invention are;

improved accuracy in launching, possible to set the dampening effect in regard to a gunner or to a projectile, easy and reliable mounting of the dampening mechanism to a launch tube, easy and reliable mounting of equipments such as a sight, a shoulder support and a firing mechanism, easy reusable dampening mechanism.

BRIEF DESCRIPTION OF FIGURES

The description of the invention is supported by the following figures where.

DETAILED DESCRIPTION

Figure 1:
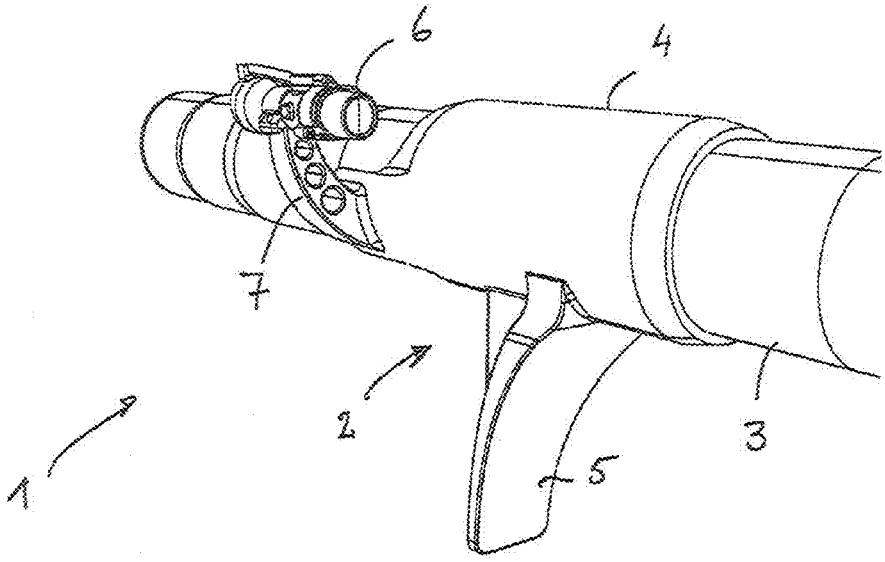
FIG. 1 shows a perspective view of a handhold recoilless weapon comprising a recoil dampener, where a shoulder support, a sight and a cover are attached to the recoil dampener.

FIG. 1 shows a recoilless weapon 1 comprising a recoil dampener 2 mounted on a launch tube 3. The recoilless weapon 1 is a handhold type of recoilless weapon from which more than one projectile can be launched (multiple launch capacity). The recoil dampener 2 may also be used for a single launch type of recoilless weapon, where the launch tube 3 is thrown or rejected after a projectile is launched. In such a single launching weapon the recoil dampener 2 may be dismounted from the launch tube 3 after launching and moved to another launch tube 3 for further use. The recoil dampener may also be dismounted for environmental friendly recycling.

Figure 2:
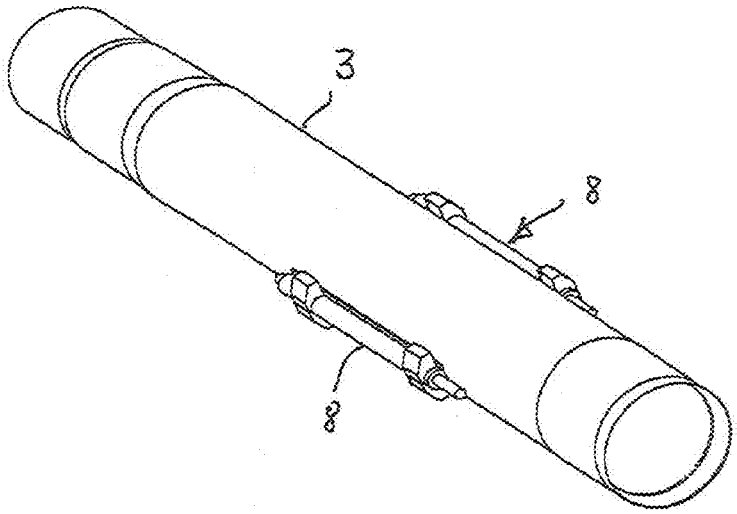
FIG. 2 shows a perspective view of the launch tube and the recoil dampener according to FIG. 1.

The recoil dampener 2 in FIG. 1, comprises at least two recoil dampening mechanisms 8 and a support cover 4 mounted to the recoil dampening mechanisms 8. The support ewer 4 comprises a shoulder rest 5, a sight 6 and at least two recoil dampening mechanisms 8. The support cover may also comprise a firing mechanism (not shown in the figure) and other attachments. The recoil dampening mechanisms 8 are attached on the side of the launch tube 3. FIG. 2. The sight 6 may be of a monocular type, a laser type or an infrared type. The sight 6 is mounted on the support cover 4 by a lever arm 7, which lever arm 7 is arranged foldable between an upward active position and a downward non-active position.

The support cover 4 is, preferably, fanned in order to protect the recoil dampening mechanisms 8 from impacts and environmental influences such as snow, ice, dust and corrosive gases. The shoulder support should be easy and reliable replaceable, preferably, foldable mounted on the support cover 4, e.g. in a recess where it can be locked in place by a locking mechanism, such as a snap mechanism.

Figure 3:
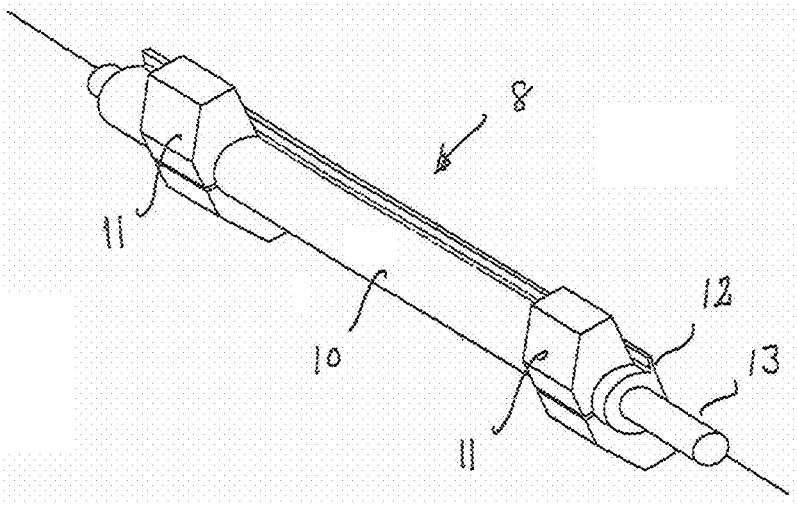
FIG. 3 shows a perspective view of the dampening mechanism according to FIG. 2.

Each recoil dampening mechanism 8, FIG. 3, is contained in a recoil dampening mechanism housing 10, which recoil dampening mechanism housing 10 comprises a mounting part with extending flanges for mounting the recoil dampening mechanism housing 10 to the launch tube 3.

The recoil dampening mechanism housing 10 is mounted to the launch tube 3 by sliding the recoil dampening mechanism housing 10 along the launch tube 3 such that the extending flanges matches into corresponding splines or grooves arranged on the launch tube 3. The recoil dampening mechanism housing 10 is finally locked in place, preferably, by screws or bolts. Alternatively, the recoil dampening mechanism housings 10 may be locked by a snap mechanism.

Figure 4:
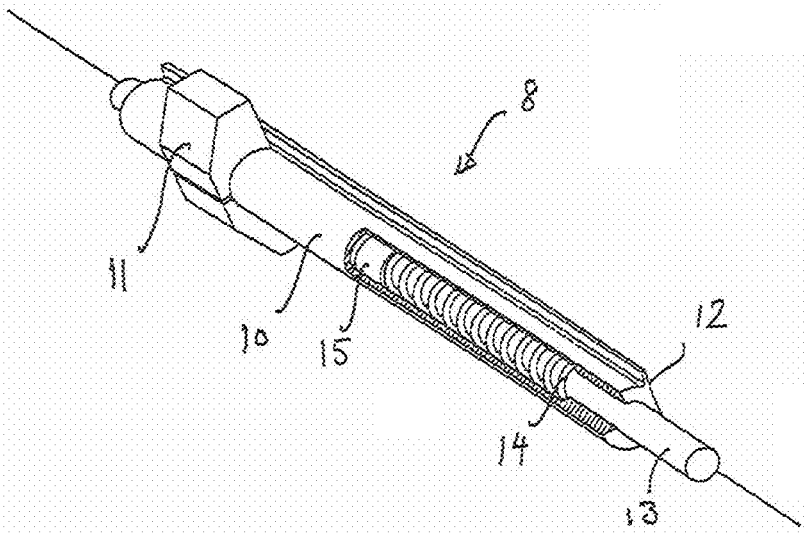
FIG. 4 shows a cutting view of the dampening mechanism according to FIG. 3.

The recoil dampening mechanism 8, FIG. 4, further comprises recoil dampening means 13, 14, 15 arranged inside the recoil dampening mechanism housing 10. The recoil dampening means comprises a slidably mounted piston 13 in a piston cylinder 15, which piston 13 is biased by at least one spring 14.

In one embodiment, two coil springs 14 are arranged coaxially on the piston 13, one coil spring at each side of the piston cylinder 15.

In response to recoil threes from a launched projectile, the launch tube 3 will move backwardly, relative to the support cover 4. As the launch tube 3 moves backwardly, the pistons 13, to which the recoil dampener 2 is attached, slides axially in the piston cylinder 15, inside the recoil dampening mechanism housing 10.

The distance (piston stroke), of which the pistons 13 moves in the recoil dampening mechanism housing 10, for a defined recoil force, corresponds to the dampening effect of the dampening mechanism 8. A short piston stroke corresponds to a low dampening effect while a long piston stroke corresponds to a high dampening effect. The piston stroke is determined by the resistance or the force of the coil spring 14, high resistance means a short piston stroke and a low resistance means a long piston stroke.

To adjust the dampening effect, different coil springs with different resistance, may be used. For further adjustment of the dampening effect, assuming that one coil spring 14 is used and that the piston cylinder 15 is closed at one end, the piston cylinder 15 may be arranged such that it can be filled with a compressed fluid of different pressure to obtain correct dampening characteristics. The fluid may contain magneto resistive particles in order to make the system magneto resistive adjustable. The dampener may also be arranged such that it takes into account the temperature of the weapon, the acceleration and the position of the launch tube relative to the cover 4. Furthermore, the spring may be of different kinds such as, a coil spring a gas spring or an electromagnetic spring or solenoid. The spring may also be replaced by an elongated rubber element. In a further special version the spring may be replaced by electromagnetic elements.

When using electromagnetic springs or solenoids, the dampening effect may be adjusted by varying the applied voltage to the electromagnetic springs.

In an alternative embodiment the dampening effect may be adjusted manually, by sliding the support cover 4 to different positions along the pistons 12.
which positions corresponds to different piston strokes. The different positions are marked by scores on the sides of the launch tube 3.

After positioning of the support cover 4 to a specific position (score), the support cover 4 is fixed, preferably by using a clamping device, which clamping device, is arranged on the support cover 4. The clamping device provides a rear stop for the support cover 4 such that the cover 4 is prevented from moving rearward relative to the launch tube.

The support cover 4 comprises mounting and locking means, arranged on the inside part of the support cover 4, for mounting and locking the support cover 4 to the pistons 13. The mounting and locking means, preferably, consist of clamping elements, which clamping elements are provided with locking elements. The locking elements, preferably, consist of screws or bolts or may consist of snap locking mechanisms.

To further restrict the movement of the support cover 4 and prevent twisting or tilting of the cover 4 relative to the longitudinal axis of the launch tube 3, and to restrict the movement of the support cover 4 between two end positions, the recoil dampening mechanism housing 10 is provided with bearing pads 11. The bearing pads 11 are mounted on the recoil dampening mechanism housings 8, one hearing pad 11 at each end of the recoil dampening mechanism housings 8. The bearing pads 11 are steadily fixed on the recoil dampening mechanism housings 10 such that the recoil dampening mechanism housings 10 slides in splines or grooves on the inner sides of the support cover 4. The bearing pads 11 may be pretension such that the dampening effect of the recoil mechanism is adjustable. The sliding/guiding/bearing surfaces may also be plated with hard- and wear resistant surface coating to obtain defined dampening effects. Each splines or groove may have a length which corresponds to a maximum length of which the launch tube 3 are allowed to move relative to the support cover 4.

The invention claimed is:

1. A recoilless weapon comprising:

a launch tube for launching a projectile; and a recoil dampener for dampening recoil forces from the projectile, the recoil dampener including at least two recoil dampening mechanisms;

a support cover covering the recoil damper, the support cover including a shoulder rest, a sight and a firing mechanism; and wherein that the recoil dampener is adjustable by adjusting the support cover axially along the launch tube.

2. A recoilless weapon according to claim 1, characterised in that the at least two recoil dampening mechanisms are mounted in a recoil dampening mechanism housing, which recoil dampening mechanism housing comprises mounting and locking means for mounting and locking the recoil dampening mechanism housing on the launch tube.

3. A recoilless weapon according to claim 2, characterised in that the mounting and locking means comprises a snap mechanism.

4. A recoilless weapon according to claim 1, wherein each recoil dampening mechanism comprises at least two bearing pads, a piston, a piston cylinder and at least one spring.

5. A recoilless weapon according to claim 4, characterised in that the piston is slideable mounted in a piston cylinder inside a recoil dampening mechanism housing and that the piston is biased by the at least one spring, which spring is a coil spring and arranged coaxially on the piston.

6. A recoilless weapon according to claim 4, characterised in that the support cover is mounted on the pistons.

7. A recoilless weapon according to claim 4, characterised in that the recoil dampener is adjustable by biasing the bearing pads radially towards support cover.

8. A recoilless weapon according to claim 1, characterised in that the support cover is mounted on pistons.

9. A recoilless weapon according to claim 1, characterised in that the shoulder rest and the sight are mounted on the support cover by snap mechanisms.

10. A recoilless weapon according to claim 1, characterised in that the sight is mounted on a lever arm, which lever arm is foldable between an active position and a non-active position.

11. A recoilless weapon according to claim 1, characterised in that the dampening of the recoil dampener is adjustable by adjusting the support cover axially along the launch tube.

* * * * *